US009496658B1

(12) United States Patent
Chiu et al.

(10) Patent No.: US 9,496,658 B1
(45) Date of Patent: Nov. 15, 2016

(54) CONNECTING DEVICE FOR CONNECTING A CABLE AND A SOCKET

(71) Applicant: GT CONTACT CO., LTD., New Taipei (TW)

(72) Inventors: Jui-Jung Chiu, Taoyuan County (TW); Chih-Cheng Tsai, New Taipei (TW)

(73) Assignee: GT CONTACT CO., LTD., New Taipei (TW)

( * ) Notice: Subject to any disclaimer, the term of this patent is extended or adjusted under 35 U.S.C. 154(b) by 0 days.

(21) Appl. No.: 14/952,873

(22) Filed: Nov. 25, 2015

(51) Int. Cl.

| | |
|---|---|
| ***H01R 12/00*** | (2006.01) |
| ***H01R 13/66*** | (2006.01) |
| ***H01R 13/52*** | (2006.01) |
| ***H01R 24/60*** | (2011.01) |
| *H01R 107/00* | (2006.01) |
| *H01R 12/71* | (2011.01) |

(52) U.S. Cl.
CPC ..... *H01R 13/665* (2013.01); *H01R 13/5202* (2013.01); *H01R 24/60* (2013.01); *H01R 12/716* (2013.01); *H01R 2107/00* (2013.01)

(58) Field of Classification Search
USPC ..... 439/320, 76.1
See application file for complete search history.

(56) References Cited

U.S. PATENT DOCUMENTS 3,951,490 A * 4/1976 Devendorf ..... H01R 9/0506 174/59
4,375,308 A * 3/1983 Wilkinson ..... G06M 1/02 439/171
4,857,002 A * 8/1989 Jensen ..... H05K 1/167 338/307
5,554,037 A * 9/1996 Uleski ..... H01R 9/091 439/741
5,620,331 A * 4/1997 Los ..... H01R 12/58 439/404
5,967,802 A * 10/1999 Daly ..... H01R 13/6658 439/620.09
6,375,477 B2 * 4/2002 Nishikawa ..... H05K 5/0069 439/76.1
7,674,116 B2 * 3/2010 Chen ..... H01R 9/032 439/76.1
8,011,935 B2 * 9/2011 Ko ..... H01R 13/5845 439/490
2010/0151707 A1 * 6/2010 AbuGhazaleh .... H01R 13/6272 439/76.1

* cited by examiner

*Primary Examiner* — Tho D Ta
(74) *Attorney, Agent, or Firm* — Li & Cai Intellectual Property (USA) Office

(57) ABSTRACT

A connecting device includes a housing, connector module, and a cover. The housing has a first end and a second end, a container is disposed inside the housing, the inner wall of the housing is formed with a stop portion and a first buckle portion. The connector module includes a connector and a printed circuit board, the printed circuit board has a first surface and a second surface, the connector module is disposed in the container of the housing, and the second surface of the printed circuit board is abutted against a stop portion of the housing. A cover is disposed inside the container and near the first end, the cover has a first opening. An outer wall of the cover comprises a second buckle portion, and the second buckle portion is engaged with the first buckle portion, so the cover is fixed to the housing.

12 Claims, 5 Drawing Sheets

CONNECTING DEVICE FOR CONNECTING A CABLE AND A SOCKET

BACKGROUND OF THE INVENTION

1. Field of the Invention

The present invention is related to a connecting device, in particular, to a connector installed inside the connecting device.

2. Description of Related Art

Electronic equipment transfers signals or information by connectors, wherein the connectors have a plug and a socket for transferring the electric energy or signals. However, conventional connector modules too easily become unfastened while disposed inside the connecting device.

In summary, the inventor of this instant disclosure has contributed to research and developed the connector of the instant disclosure to overcome the abovementioned drawbacks.

SUMMARY OF THE INVENTION

The object of the instant disclosure is to provide a connecting device. A connector module is installed firmly in the housing of the connecting device and assembled or taken apart quickly.

According to one exemplary embodiment of the present invention, the connecting device includes a housing, the housing has a first end and a second end, a container is disposed inside the housing and between the first end and the second end. An inner wall of the housing is formed with at least one stop portion and at least one first buckle portion. A connector module has a connector and a printed circuit board. The connector comprises an inserting section and a connecting section. The printed circuit board is connected to the connecting section of the connector module, so the connector module is electrically connected to the printed circuit board. The printed circuit board has a first surface and a second surface, the first surface and the second surface is located on relative opposite sides of the printed circuit board. The first surface of the printed circuit board is facing the connector, whereas the second surface is facing away from the connector. The connector module is disposed in the container of the housing. The inserting section of the connector is located near the first end of the housing and far from the second end of the housing. The second surface of the printed circuit board is abutted against the at least one stop portion. A cover is disposed inside the container near the first end. The cover has a first opening corresponding to the connector of the connector module. An outer wall of the cover comprises at least one second buckle portion, the at least one second buckle portion is engaged with the at least one first buckle portion, so the cover is fixed to the housing. One end of the cover is formed with a pressing end, the pressing end is abutted against the first surface of the printed circuit board, so the printed circuit board of the connector module is embedded between the at least one stop portion of the housing and the pressing end of the cover.

The instant disclosure has the following advantages:

The connecting device in the present invention has a housing, a connector module, and a cover. An inner wall of the housing is disposed with a stop portion and a first buckle portion. The connector module is disposed inside a container of the housing, and the second surface of the printed circuit board of the connector module is abutted against the stop portion. The cover is installed in the container of the housing, and an outer wall of the cover is disposed with a second buckle portion, so the second buckle portion is engaged with the first buckle portion, so the cover is fixed to the housing. One end of the cover is formed with a pressing end, the pressing end is abutted against the first surface of the printed circuited board, so the printed circuit board of the connector module is embedded between the stop portion of the housing and the pressing end of the cover, so the connector module is installed firmly in the housing and the cover is fixed to the housing, and the connector module can be installed in or detached from the connecting device quickly.

Preferably, a pressing end is formed on an edge of one end of the cover, and the pressing end is abutted against an edge of the first surface of the printed circuit board, the pressing end of the cover provides a pressing force to the first surface of the printed circuit board along a longitude direction of the connecting device, so the cover is pressed to the connector module firmly.

Preferably, a portion of the cover near the first end, a portion of the printed circuit board near the first end, and a portion of the container near the first end, are formed with a non-circular shape and provide a well fixed effect, and the housing, and the connector module and the cover are not rotated accordingly.

For further understanding of the instant disclosure, reference is made to the following detailed description illustrating the embodiments and examples of the instant disclosure. The description is for illustrative purpose only and is not intended to limit the scope of the claim.

DETAILED DESCRIPTION OF THE PREFERRED EMBODIMENTS

First Embodiment

Figure 1:
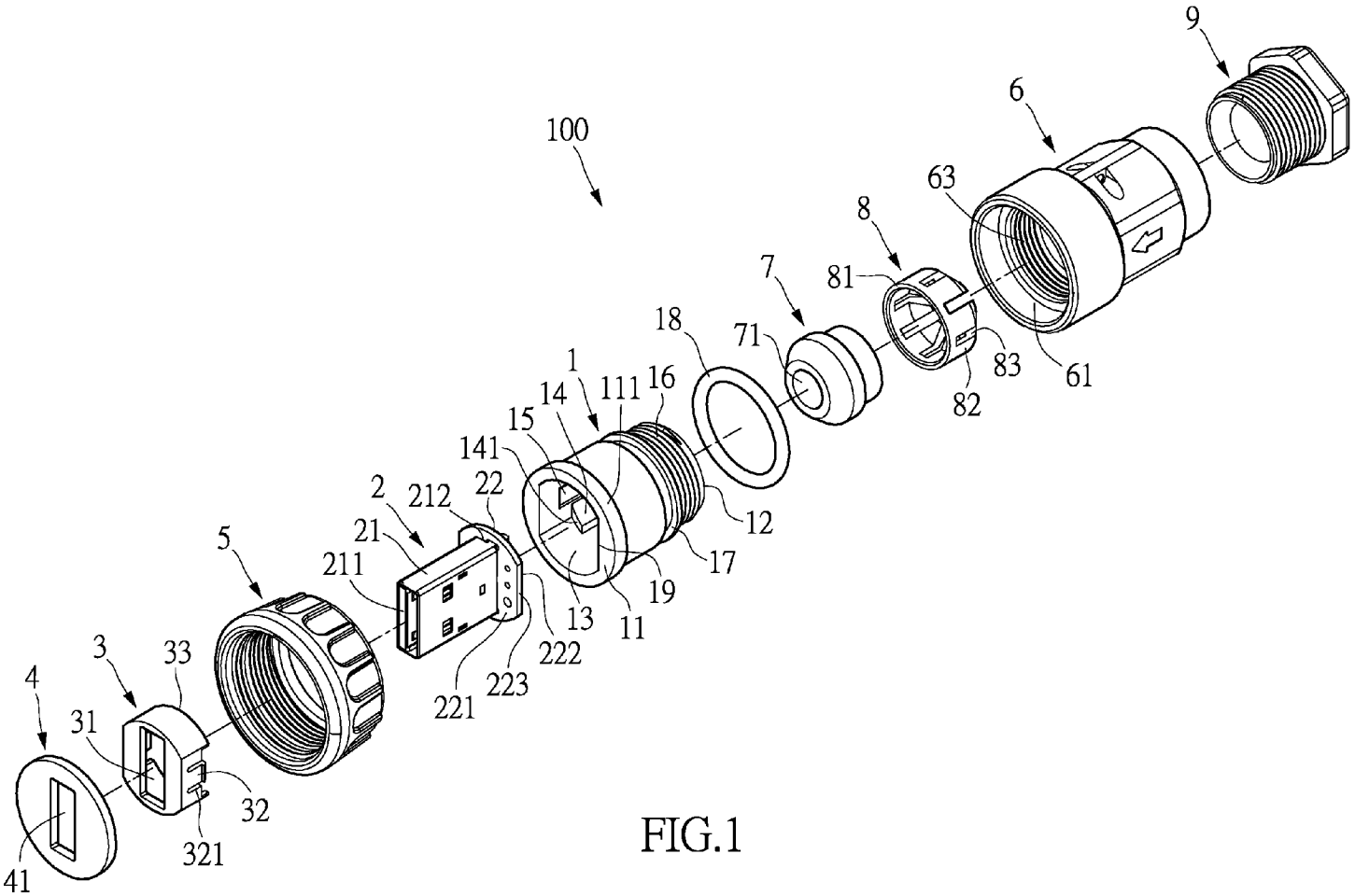
FIG. 1 illustrates an exploded view of a connecting device in the instant disclosure.
Figure 2:
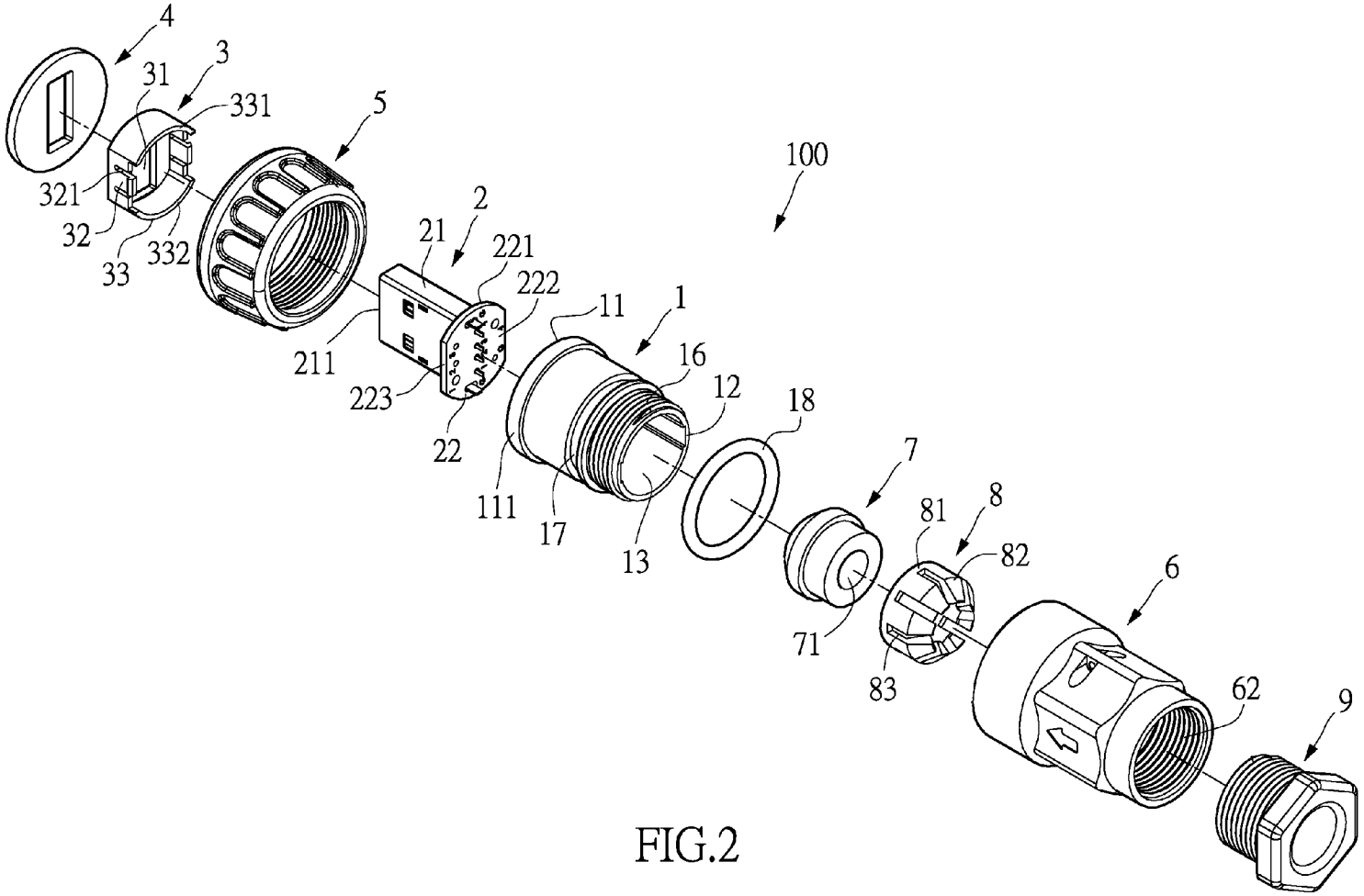
FIG. 2 illustrates another exploded view of a connecting device in the instant disclosure.
Figure 3:
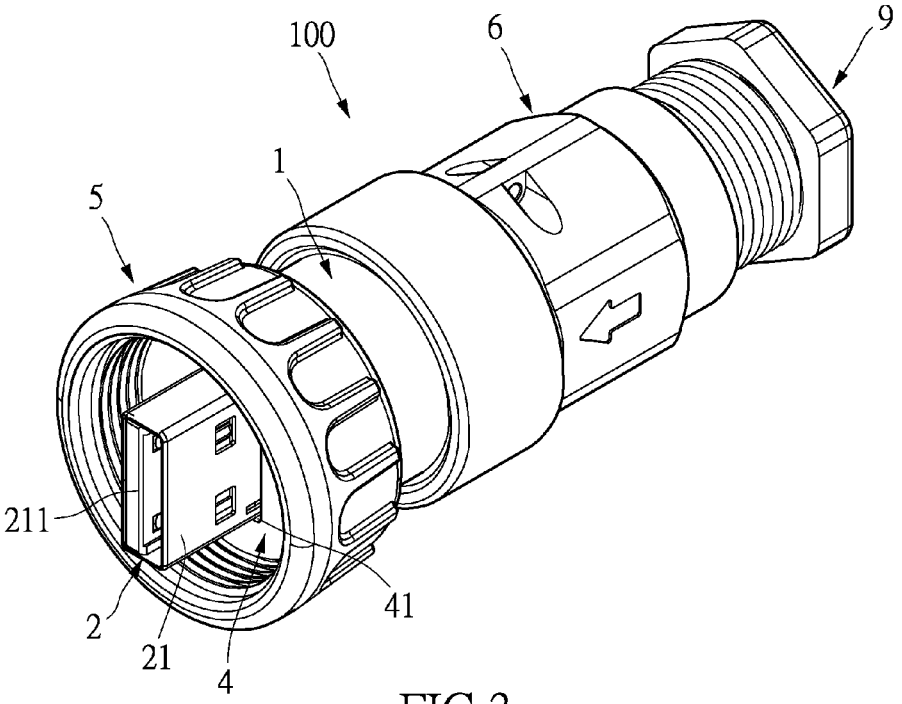
FIG. 3 illustrates a perspective view of a connecting device in the instant disclosure.
Figure 4:
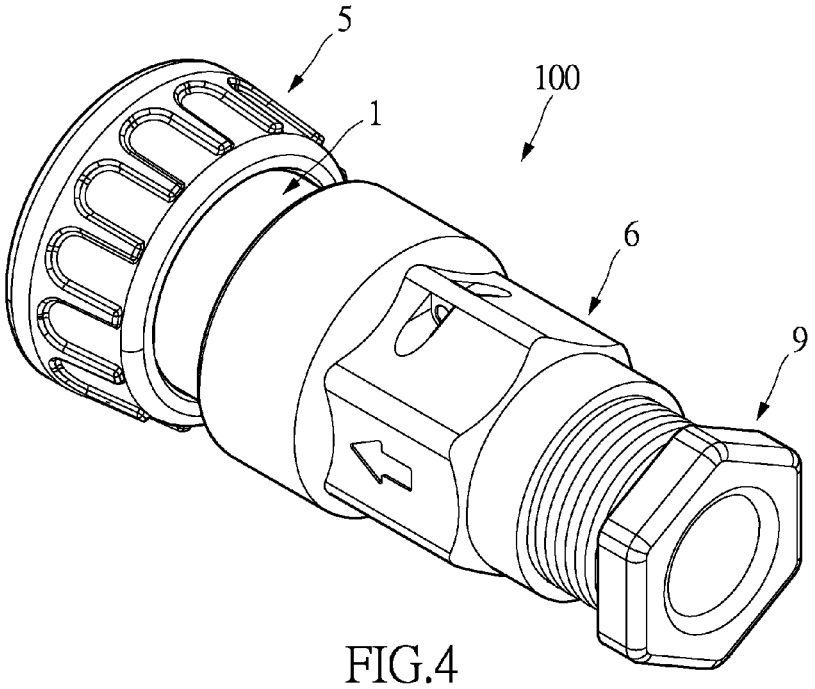
FIG. 4 illustrates another perspective view of a connecting device in the instant disclosure.
Figure 5:
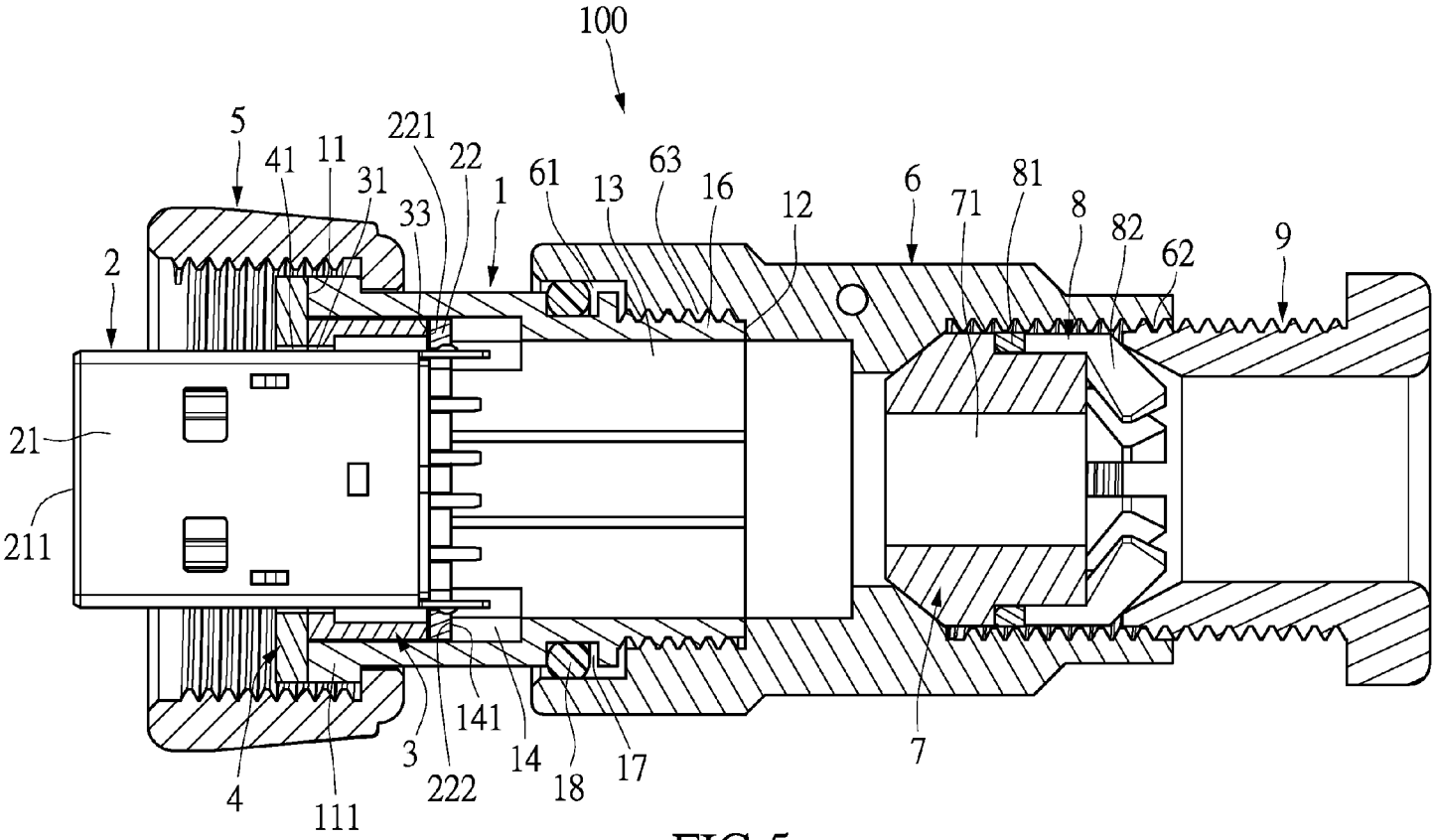
FIG. 5 illustrates a section view of a connecting device in the instant disclosure.

With reference to FIG. 1-5, the instant disclosure provides a connecting device 100. The connecting device 100 comprises a housing 1, a connector module 2 and a cover 3. The connecting device 100 further comprises a rubber mat 4 and a connecting member 5.

The housing 1 is hollow, the housing 1 has a first end 11 and a second end 12, the first end 11 and second 12 are located at opposite sides of the housing 1 respectively. A container 13 is disposed inside the housing 1 and between the first end 11 and second end 12. The container 13 extends from the first end 11 to the second end 12, so the first end 11 and the second end 12 form an opening respectively.

The inner wall of the housing 1 is formed with at least one stop portion 14. In other words, the stop portion 14 is located near the first end 11, and disposed in the container 13 of the housing 1. The stop portion 14 has a stop surface 141, the stop surface 141 faces the first end 11. The stop portion 14 is disposed in the inner wall of the housing 1 and arranged continuously or at regular intervals, so limiting the movement of the connector module 2. The structure of the stop portion 14 may be, but is not limited to, a plug, a flange and suchlike. The stop portion 14 is used to fix and limit the movement of the connector module 2. The stop portion 14 may, but is not limited to, integrate with the inner wall of the housing 1.

The inner wall of the housing 1 is formed with at least one first buckle portion 15, specifically, the first buckle portion 15 is located near the first end 11 and disposed in the inner wall of the housing 1. The inner wall of the housing 1 may be formed with one, two or three first buckle portions 15. Preferably, two first buckle portion 15 are disposed on the opposite sides of the container 13 respectively and utilized to fix the cover 3. The structure of the first buckle portion 15 may be, but is not limited to, a groove, a hook, a block and suchlike. In this embodiment, the first buckle portion 15 is a groove.

The outer wall of the housing 1, near the second end 12, further comprises a first screw thread portion 16. The first screw thread portion 16 is an external thread and utilized to connect a corresponding element. The out wall of housing 1 further comprises a circular groove 17, and an O ring 18 is disposed in the circular groove 17 for sealing.

The connector module 2 is an electrical connecting device, the connector module 2 includes a connector 21 and a printed circuit board 22. The connector 21 may be, but is not limited to, a USB connector, DC connector, audio connector, video connector, IEEE 1394 connector, HDMI connector and suchlike. The connector 21 has an inserting section 211 and a connecting section 212, the inserting section 211 and the connecting section 212 is disposed on opposite sides of the connector 21 respectively. The printed circuit board 22 is connected to the connecting section 212 of the connector 21, and the connector 21 is electrically contactable to the printed circuit board 22, so the connector 21 is electrically connected to the cables by printed circuit board 22.

The shape of the printed circuit board 22 is not limited, in this embodiment, the printed circuit board 22 is with a non-circular shape. The printed circuit board 22 has a first surface 221 and a second surface 222, the first surface 221 and the second surface 222 are disposed on the opposite sides of the printed circuit board 22 respectively, and the first surface 221 is connected the connecting section 212 of the connector 21. The first surface 221 of the printed circuit board 22 is facing the connector 21, whereas the second surface 222 of the printed circuit board 22 is faced away from the connector 21. The width of the printed circuit board 22 is greater than the width of the connector 21, so the printed circuit board 22 extends outward from the outer wall of the connector 21. In other words, the first surface 221 of the printed circuit board 22 connects the connecting section 212 of the connector 21, and part of the first surface 221 of the printed circuit board 22 is exposed to the connecting section 212 of the connector 21, so the back end of the cover 3 is abutted against the first surface 221 of the printed circuit board 22.

The connector module 2 is disposed in the container 13 of the housing 1. In other words, the connector module 2 is installed in the container 13 through the first end 11 of the housing 1. The inserting section 211 is located near the first end 11 of the housing 1 and far away from the second end 12 of the housing 1. The second surface 222 of the printed circuit board 22 is abutted against the stop surface 141 of the stop portion 14. Specifically, the second surface 222 of the printed circuit board 22 is abutted against the stop surface 141 of the stop portion 14, so the connector module 2 can not move toward the direction of the second end 12 of the housing 1, and the connector module 2 is fixed to the housing 1. The connector module 2 is disposed in the container 13 of the housing 1, and the connector 21 of the connector module 2 protrudes outward from the first end 11 of the housing 1, so the connector 21 is available to connect to the corresponding electrical connecting device.

In this embodiment, the printed circuit board 22 approximately assumes a circular shape, but both sides of the printed circuit board 22 are cut and formed with first straight sides 223 respectively, so the printed circuit board 22 is non-circular. The inner wall of the housing 1 near the first end 11 is formed with two second straight sides 19 corresponding the first straight sides 223. The container 13 near the first end 11 is with a non-circular shape corresponding the shape of the printed circuit board 22, and the first straight sides 223 are matched with the second straight sides 19, to prevent rotation between the housing 1 and the connector module 2.

The cover 3 is hollow and the shape is not limited. The shape of the cover 3 is corresponding to the printed circuit board 22 and the first end 11 of the container 13, so the cover 3 is installed near the first end 11 in the container 13. The cover 3 has a first opening 31 corresponding to the connector 21 of the connector module 2. The connector 21 of the connector module 2 extends outward through the first opening 31 and is available to plug into the corresponding electrical connecting device.

The outer wall of the cover 3 may be formed with one, two, or three second buckle portions 32. Preferably, two second buckle portions 32 are disposed on opposite sides of the cover 3 respectively. The structure of the second buckle portion 32 may be, but is not limited to, a groove, a hook, a block and suchlike. In this embodiment, the second buckle portion 32 is a hook, preferably, the second buckle portion 32 is, but is not limited to, an elastic hook. Specifically, two grooves 321 are formed in both sides of the second buckle portion 32 respectively, so the second buckle portion 32 is formed into an elastic hook which is available to swing outwards or inwards.

The second buckle portion 32 engages with the first buckle portion 15, so the cover 3 is fixed to the housing 1. A pressing end 33 is formed in the back end of the cover 3, and abutted against the first surface 221 of the printed circuit board 22. More specifically, the pressing end 33 of the cover 3 provides a pressing force to the first surface 221 of the printed circuit board 22 along a longitude direction of the connecting device 100, and the printed circuit board 22 of the connector module 2 is embedded between the stop portion 14 of the housing 1 and the pressing end 33 of the cover 3, so the connector module 2 is fixed to the housing 1 firmly.

In this embodiment, the pressing end 33 is formed near the edge of the back end of the cover 3, so the pressing end 33 is located far away from the center of the cover 3. More specifically, the pressing end 33 of the cover 3 is abutted against the edge of the first surface 221 of the printed circuit board 2, and provides a pressing force to the connector module 2. Moreover, the pressing end 33 is divided into a first pressing portion 331 and a second pressing portion 332, the first pressing portion 331 and the second pressing portion 332 are with a symmetrical curved shape. The first pressing portion 331 and the second pressing portion 332 are abutted against the opposite sides of the first surfaces 221 of the printed circuit board 22, and provide an even strength on the printed circuit board 22.

In this embodiment, a portion of the cover 3 near the first end 11, a portion of the printed circuit board 22 near the first end 11, and a portion of the container 13 near the first end 11, are formed with a non-circular shape, so the printed circuit board 22 of the connector module 2 is disposed in the container 13 with fixing effect.

A rubber mat 4 is disposed in the first end 11 of the housing 1, the rubber mat is formed with a second opening 41, the connector 21 of the connector module 2 extends outwards through the second opening 41, and plugs into corresponding electrical connecting device. A connecting member 5 is fastened around the outer wall of the housing 1, a flange 111 is formed near the first end 11 in the outer wall of the housing 1, one end of the connecting member 5 is abutted against the flange 111, and the connecting member 5 is utilized to engage the corresponding electrical connecting device.

The connecting device 100 in the present invention further comprises a joining tube 6, a sealing member 7, a secured ring, and a joint element 9, to facilitate the cables passing through accordingly. The joining tube 6 is hollow, comprises a first opening end 61 and a second opening end 62. The first opening end 61 is formed with a second screw thread portion 63. The second screw thread portion 63 is an internal screw thread, and the second screw thread portion 63 engages with the first screw thread portion 16 of the housing 1, so the joining tube 6 connects to the housing 1. An O ring 18 is disposed between the inner wall of the joining tube 6 and the outer wall of the housing 1 for sealing.

A secured ring 8 has a ring body 81 and a plurality of claws 82, the claws 82 arranged at regular intervals. More specifically, a gap 83 is located between the adjacent claws 82, so the adjacent claws 82 could expand or close accordingly. The sealing member 7 and secured ring 8 are disposed inside the joining tube 6 and near the second opening end 62. The secured ring 8 is abutted against the sealing member 7 and the joining tube 6 respectively.

A joint element 9 is hollow, and engages the second opening end 62 of the joining tube 6. One end of the joint element 9 is abutted against the outer wall of the claws 82. While the joint element 9 enters the joining tube 6, the joint element 9 is abutted against the claws 82, so the claws 82 retract, and the secured ring 8 is abutted against the sealing member 7, and the hole 71 of the sealing member 7 is reduced.

When a plurality of cables pass through the sealing member 7 and secured ring 8 and are electrically contactable to the connector module 2, the joining tube 6, the sealing member 7, the secured ring 8, and the joint element 9 are configured to tie the cables, so the cables are installed in the connecting device 100 firmly.

Second Embodiment

Figure 6:
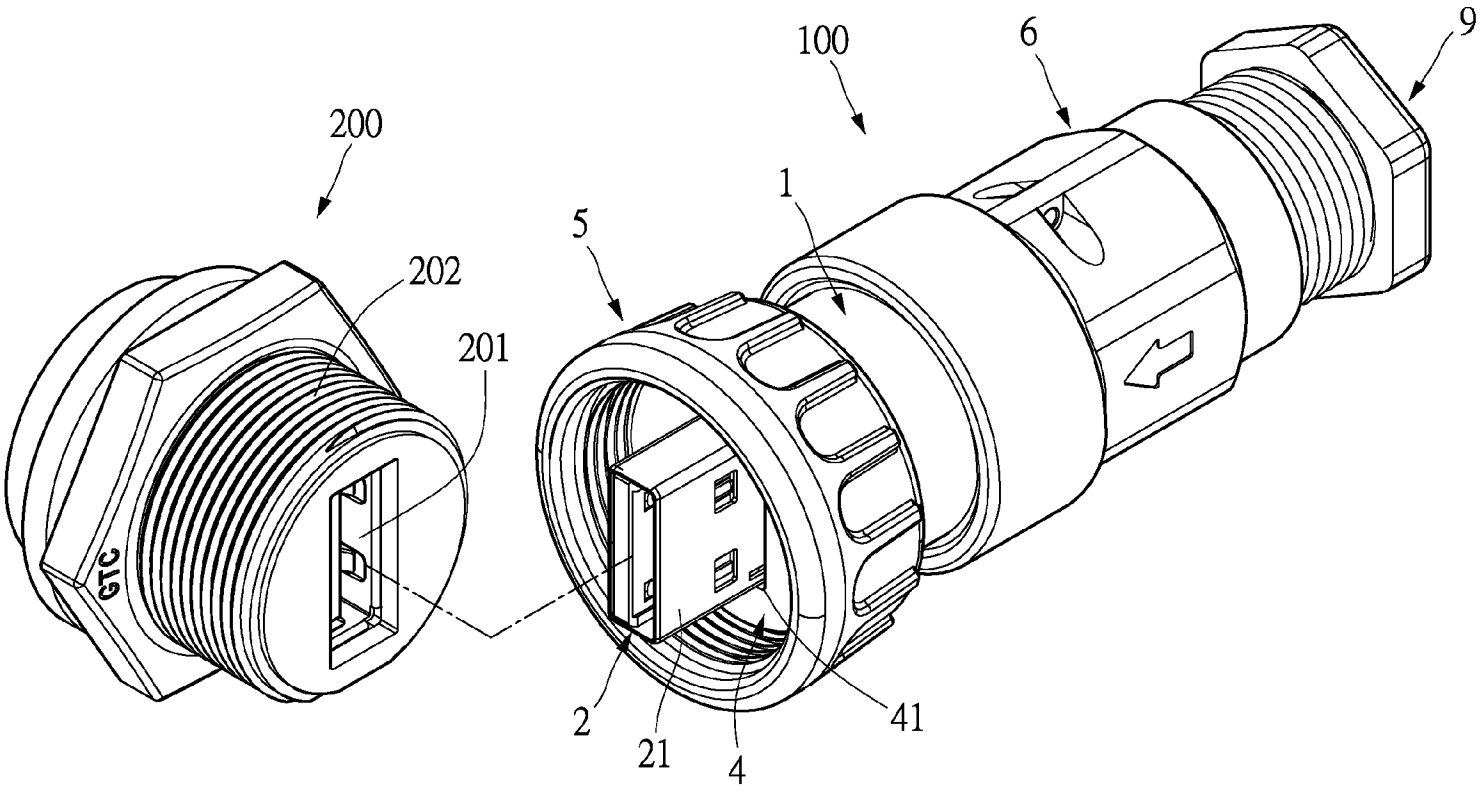
FIG. 6 illustrates a perspective view of a connecting device in the instant disclosure connecting to another connecting device.

With reference to FIG. 6, the electrical connecting device 200 has a female connector 201, when the connector 21 of the connector 2 plugs into the female connector 201 of the electrical connecting device 200, an electrical connection is established. The connecting member 5 is utilized to engage the connecting element 202 of the electrical connecting device 200, so the connecting device 100 connects the electrical connecting device 200 firmly. The rubber mat 4 is sandwiched between the connecting device 100 and the electrical connecting device 200 for sealing.

The connecting device of the present invention has a housing, a connector module, and a cover. An inner wall of the housing is disposed with a stop portion and a first buckle portion. The connector module is disposed inside a container of the housing, and the second surface of the printed circuit board of the connector module is abutted against the stop portion. The cover is installed in the container of the housing, an outer wall of the cover is disposed with a second buckle portion, the second buckle portion is engaged with the first buckle portion, so the cover is fixed to the housing. One end of the cover is formed with a pressing end, the pressing end is abutted against the first surface of the printed circuited board, so the printed circuit board of the connector module is embedded between the stop portion of the housing and the pressing end of the cover. The connector module is installed firmly in the housing and the cover is fixed to the housing, so the connector module could be installed in or detached from the connecting device quickly.

The descriptions illustrated supra set forth simply the preferred embodiments of the instant disclosure; however, the characteristics of the instant disclosure are by no means restricted thereto. All changes, alterations, or modifications conveniently considered by those skilled in the art are deemed to be encompassed within the scope of the instant disclosure delineated by the following claims.

What is claimed is:

1. A connecting device for connecting a cable and a socket, comprising:

a housing, having a first end and a second end, a container disposed inside the housing and between the first end and the second end, an inner wall of the housing formed with at least one stop portion and at least one first buckle portion;

a connector module, having a connector and a printed circuit board, the connector comprising an inserting section and an connecting section, the printed circuit board connected to the connecting section of the connector module, and the connector module electrically connected to the printed circuit board, the printed circuit board having a first surface and a second surface, the first surface and the second surface located on relative opposite sides of the printed circuit board, the first surface of the printed circuit board facing the connector, and the second surface facing away from the connector, the connector module disposed in the container of the housing, the inserting section of the connector located near the first end of the housing and far from the second end of the housing, the second surface of the printed circuit board abutted against the at least one stop portion;

a cover, disposed inside the container near the first end, the cover having a first opening corresponding to the connector of the connector module, an outer wall of the cover comprising at least one second buckle portion, the at least one second buckle portion engaged with the at least one first buckle portion, so the cover is fixed to the housing, one end of the cover formed with a pressing end, the pressing end abutted against the first surface of the printed circuit board, so the printed circuit board of the connector module is embedded between the at least one stop portion of the housing and the pressing end of the cover;

a rubber mat, the rubber mat is disposed in the first end of the housing, the rubber mat has a second opening, the connector of the connector module passes through a second opening and extends outward; and a connecting member, the connecting member is nested in an outer wall of the housing, the outer wall of the housing near the first end is formed with a flange, and the connecting member abuts against the flange.

2. The connecting device for connecting a cable and a socket according to claim 1, wherein the pressing end is formed on an edge of one end of the cover, and the pressing end is abutted against an edge of the first surface of the printed circuit board, the pressing end of the cover provides a pressing force to the first surface of the printed circuit board along a longitude direction of the connecting device.

3. The connecting device for connecting a cable and a socket according to claim 1, wherein a portion of the cover near the first end, a portion of the printed circuit board near the first end, and a portion of the container near the first end, are formed with a non-circular shape, the at least one stop portion has a stop surface, the stop surface faces the first end of the housing, and the second surface of the printed circuit board abuts against the stop surface of the stop portion.

4. The connecting device for connecting a cable and a socket according to claim 1, wherein the at least one first buckle portion is disposed in the inner wall of the housing near the first end, the at least one first buckle portion is a slot, and the at least one second buckle portion is a snap, the connecting device further comprises two first buckle portions and two second buckle portions, the two first buckle portions are disposed on the opposite sides of the container respectively, and the two second buckle portions are disposed on the opposite side of the cover respectively.

5. The connecting device for connecting a cable and a socket according to claim 1, wherein the pressing end is divided into a first pressing portion and a second pressing portion, the first pressing portion and the second pressing portion are abutted against the opposite sides of the first surface of the printed circuit board.

6. The connecting device for connecting a cable and a socket according to claim 1, wherein the width of the printed circuit board is greater than the width of the connector, so the printed circuit board extends outward from an outer wall of the connector, and part of the first surface of the printed circuit board is exposed to the connecting section of the connector.

7. The connecting device for connecting a cable and a socket according to claim 1, wherein the connector of the connector module extends outward from the first end of the housing, and the connector of the connector module passes through the first opening and extends outward.

8. The connecting device for connecting a cable and a socket according to claim 1, wherein both sides of the printed circuit board form with a first straight side respectively, and the inner wall of the housing near the first end is formed with two second straight sides.

9. The connecting device for connecting a cable and a socket according to claim 1, an outer wall of the housing near the second end is formed with a first screw thread portion, the outer wall of the housing is formed with a circular groove, and an O ring is disposed in the circular groove.

10. The connecting device for connecting a cable and a socket according to claim 9, further comprises a joining tube, a sealing member, a secured ring and a joint element, the joining tube has a first opening end and a second opening end, the first opening end is formed with a second screw thread portion, and the second screw thread portion engages with the first screw thread portion of the housing, the O ring is disposed between an inner wall of the joining tube and an outer wall of the housing, the secured ring has a ring body and a plurality of claws connected to the ring body, the claws are arranged at regular intervals, the sealing member and the secured ring are disposed inside the joining tube, the secured ring abuts against the sealing member and the joining tube, the joint element engages with the second opening end of the joining tube, and one end of the joint element abuts against an outer wall of the claws.

11. A connecting device for connecting a cable and a socket, comprising:

a housing, having a first end and a second end, a container disposed inside the housing and between the first end and the second end, an inner wall of the housing formed with at least one stop portion and at least one first buckle portion;

a connector module, having a connector and a printed circuit board, the connector comprising an inserting section and an connecting section, the printed circuit board connected to the connecting section of the connector module, and the connector module electrically connected to the printed circuit board, the printed circuit board having a first surface and a second surface, the first surface and the second surface located on relative opposite sides of the printed circuit board, the first surface of the printed circuit board facing the connector, and the second surface facing away from the connector, the connector module disposed in the container of the housing, the inserting section of the connector located near the first end of the housing and far from the second end of the housing, the second surface of the printed circuit board abutted against the at least one stop portion;

a cover, disposed inside the container near the first end, the cover having a first opening corresponding to the connector of the connector module, an outer wall of the cover comprising at least one second buckle portion, the at least one second buckle portion engaged with the at least one first buckle portion, so the cover is fixed to the housing, one end of the cover formed with a pressing end, the pressing end abutted against the first surface of the printed circuit board, so the printed circuit board of the connector module is embedded between the at least one stop portion of the housing and the pressing end of the cover; and an outer wall of the housing near the second end is formed with a first screw thread portion, the outer wall of the housing is formed with a circular groove, and an O ring is disposed in the circular groove.

12. The connecting device for connecting a cable and a socket according to claim 11, further comprises a joining tube, a sealing member, a secured ring and a joint element, the joining tube has a first opening end and a second opening end, the first opening end is formed with a second screw thread portion, and the second screw thread portion engages with the first screw thread portion of the housing, the O ring is disposed between an inner wall of the joining tube and an outer wall of the housing, the secured ring has a ring body and a plurality of claws connected to the ring body, the claws are arranged at regular intervals, the sealing member and the secured ring are disposed inside the joining tube, the secured ring abuts against the sealing member and the joining tube, the joint element engages with the second opening end of the joining tube, and one end of the joint element abuts against an outer wall of the claws.

* * * * *